US007396986B2

(12) United States Patent
Packer

(10) Patent No.: US 7,396,986 B2
(45) Date of Patent: Jul. 8, 2008

(54) PEDAL FOR PLAYING AN INSTRUMENT AND PEDAL COMPONENTS

(76) Inventor: Michael Packer, 3065 Fair Oaks Ave., Altadena, CA (US) 91001

( * ) Notice: Subject to any disclaimer, the term of this patent is extended or adjusted under 35 U.S.C. 154(b) by 128 days.

(21) Appl. No.: 11/431,487

(22) Filed: May 10, 2006

(65) Prior Publication Data

US 2006/0272476 A1 Dec. 7, 2006

(51) Int. Cl.
*G10D 13/02* (2006.01)

(52) U.S. Cl. ..... 84/422.1

(58) Field of Classification Search ..... 84/422.1, 84/422.2, 422.3, 353, 290, 357, 426
See application file for complete search history.

(56) References Cited

U.S. PATENT DOCUMENTS

| | | | | |
|---|---|---|---|---|
| 2,446,508 | A | 8/1948 | Crowell | |
| 2,800,828 | A | 7/1957 | Moeller | |
| 4,664,012 | A | 5/1987 | Barca | |
| 4,691,613 | A | 9/1987 | Jacobson | |
| 5,574,237 | A | 11/1996 | Yanagisawa | |
| 5,767,428 | A | 6/1998 | Bloch | |
| D402,683 | S | 12/1998 | Brewster et al. | |
| 5,990,401 | A * | 11/1999 | Braun et al. | 84/422.1 |
| 6,369,308 | B1 * | 4/2002 | Orr | 84/422.1 |
| 6,570,076 | B1 | 5/2003 | Kjellgren | |
| 6,684,734 | B2 | 2/2004 | Gatzen | |
| 6,710,237 | B2 | 3/2004 | Adams | |
| 6,765,141 | B2 | 7/2004 | Shigenaga | |
| 2004/0020345 | A1 * | 2/2004 | Matsuzoe et al. | 84/422.1 |

* cited by examiner

*Primary Examiner*—Kimberly R Lockett
(74) *Attorney, Agent, or Firm*—Wayne E. Nacker

(57) ABSTRACT

A pedal for a percussion instrument, such as a bass drum, has a base plate and a foot plate pivotally mounted the base plate which is operably connected to an instrument striker. The pedal either has no heel plate or has a very short heel guide and is adapted so that when the tip of the player's foot is at an optimal position or "sweet spot" on the foot plate, the player's heel extends to the playing surface.

12 Claims, 6 Drawing Sheets

PEDAL FOR PLAYING AN INSTRUMENT AND PEDAL COMPONENTS

The present invention is directed to pedals for operating percussion musical instruments, such as a bass drum or high hat, and to components of such pedals. In particular, the invention is directed to pedals intended to be operated with the player's heel extending beyond the rear of the pedal and assuming a rest position on the playing surface, such as a floor, stage, or ground, and to components of such pedals.

BACKGROUND OF THE INVENTION

Operation of a bass drum or high hat (cymbal) is typically through a pedal mechanism that includes a depressible foot plate. The foot plate is mechanically linked to a beater ball such that when the foot plate is depressed by foot pressure, the beater ball moves through an actuate path to strike the instrument. When foot pressure is removed and the foot plate released, the beater ball is biased to return to a resting position ready to move forward again to strike the instrument when foot pressure is again applied to depress the foot plate.

The foot plate in such a pedal is pivotally mounted at a rearward location from a base plate that rests on the playing surface, such as a floor, stage, or ground. In the rest position, the foot plate is at a first acute angle relative to the base plate. The foot plate is depressed to a second acute angle relative to the base plate, the second acute angle being less than the first acute angle. This depression moves the beater ball into striking position.

In some pedal designs, e.g., U.S. Pat. Nos. 2,446,508 to Crowell, 4,691,613 to Jacobson, and 6,369,308 to Orr, the foot plate is of such length and design that the player's foot is intended to locate entirely on the foot plate during playing. The foot plate of this design typically has pads or brackets by which the player locates his or her foot on the foot plate. This is a design that is not favored by many percussionists because the player will never truly be able to relax while in the resting position. Also, the rebound of the pedal will not come back far enough, thus inhibiting the player's speed and volume. Though it is conceivable with such pedals that the player could slide his foot back so that the player's heel is on the playing surface, rather than on the pedal, the tip of the player's foot would be moved too far back for efficient playing of the instrument.

Most pedals in use today have a heel plate behind the foot plate on which the player's heel is intended to locate in a rest position, while the tip of the player's foot is intended to depress the pedal. Pedals of this design are found, for example, in U.S. Pat. Nos. 6,765,141 to Shigenaga, 6,710,237 to Adams, 6,684,735 to Gatzen, 5,574,231 to Yanagisawa, and 6,570,076 to Kjellgren, the teachings of each of these being incorporated herein by reference. The heel plate typically extends at least 4 to 6 cm. behind the foot plate.

One way of using the pedal to play the instrument is known as a "heel up" technique. The player lifts his or her heel and then depresses the pedal with his or her ball and toes. For a single beat of the instrument, the player lifts the heel, depresses the pedal, and then returns the heel to a rest position, presumably on the heel plate, if provided. For multiple consecutive beats, the heel remains up until the sequence is finished, and then returns to rest, presumably on the heel plate.

Each instrument pedal mechanism provides a "sweet spot" or "optimal location" on the foot plate, that is, a location on the foot plate that the player depresses with the tip of his or her foot for maximum rebound and control of the pedal. After depressing the pedal by pressing with the foot against this "sweet spot", the player's heel may not come to rest on the heel plate, but may drop behind or partially behind the heel plate. If so, every time the player lifts his or her heel, the heel strikes the edge of the heel plate causing discomfort, particularly after an extended playing session. To eliminate this problem, the present invention provides a pedal in which the player's heel is intended to rest comfortably on the playing surface, the playing surface being the surface on which the base plate sits, such as a floor, stage or ground.

There is also a "heel down" technique in which the player keeps his or heel down while depressing the foot plate with the tip of his or her foot. In prior art designs in which the heel is intended to rest on the heel plate, there is a tendency for the toe to slip from the "sweet spot".

BRIEF DESCRIPTION OF THE INVENTION

A foot pedal for playing a musical instrument is designed to be placed on a playing surface with the tip of the player's foot located at an optimal location on the pedal and with the player's heel resting on or positioned to rest on the playing surface.

For purpose of discussion, the pedal components will be considered to comprise a foot-actuated assembly and an instrument-sounding assembly. The foot-actuated assembly has a base plate that lies on the playing surface, a foot plate hinged to the base plate to define a pivotal axis by which the foot plate swings between a rest position at a first acute angle relative to the base plate and a foot-depressed position at a second, lesser acute angle relative to the base plate, and means on the foot plate for connecting the foot-actuated assembly to the instrument sounding assembly. The instrument-sounding assembly comprises an instrument striker, drive means operably linking the connection means of the foot plate with the instrument striker such that foot pressure on the foot plate to depress the foot plate moves the instrument striker from a position remote from an instrument into instrument-sounding contact with the instrument, and biasing means for returning the foot plate to said its position and the instrument striker to its remote position when foot pressure is removed from the foot plate.

In accordance with the invention, there exists on the foot plate an optimal position for location of the tip of the player's foot to depress the foot plate. The foot-actuated assembly is configured such that when the foot of the player is flat against the foot plate in its rest position with the tip of the player's foot in the optimal location, the heel of the player's foot rests on the playing surface.

In one embodiment of the invention, location of the player's heel on the playing surface is achieved by having the rear of the foot plate hinged closely adjacent the rear end of the base plate and with no heel plate whatsoever. The foot plate is proportioned and the pedal constructed so that when the player's foot tip is in the optimal position or "sweet spot", the player's heel rests comfortably on the playing surface, such as floor, stage, or ground, on which the base plate rests. Optionally, a very short heel guide may be located rearward of the foot plate to guide the player's foot to the playing surface.

DETAILED DESCRIPTION OF CERTAIN PREFERRED EMBODIMENTS

A significant use of pedals in accordance with the present invention is to play drums, and herein the pedal is at times referred to in terms of playing a drum. However, even when the term "drum" is used, it is to be understood that the pedal may operate other percussion musical instruments, such as cymbals.

Figure 1:
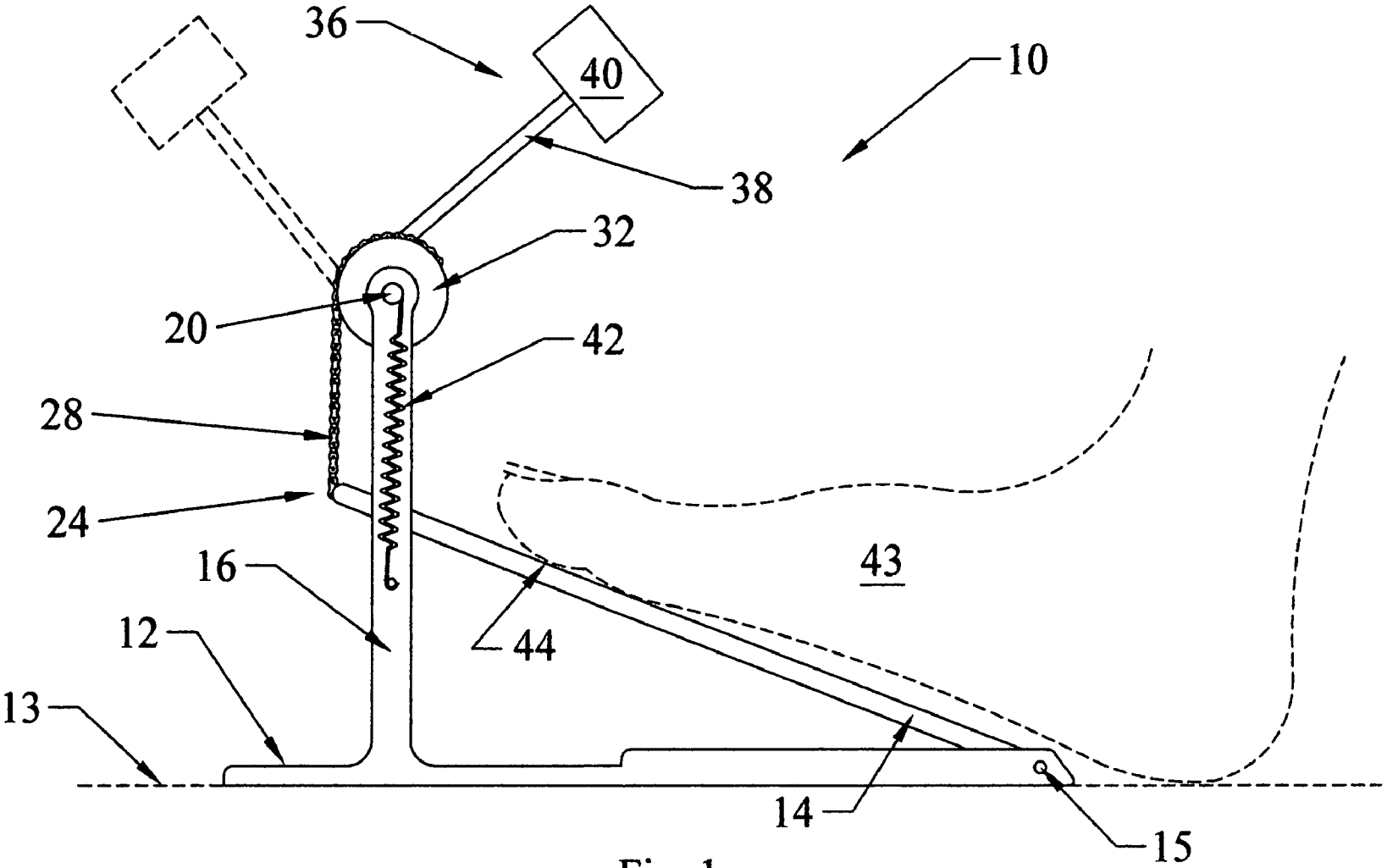
FIG. 1 is a side elevation view of a foot pedal in accordance with the invention; with a player's foot shown in the rest position with his or her toe on the "sweet spot" of the foot plate, and his or her heel on the playing surface.
Figure 2:
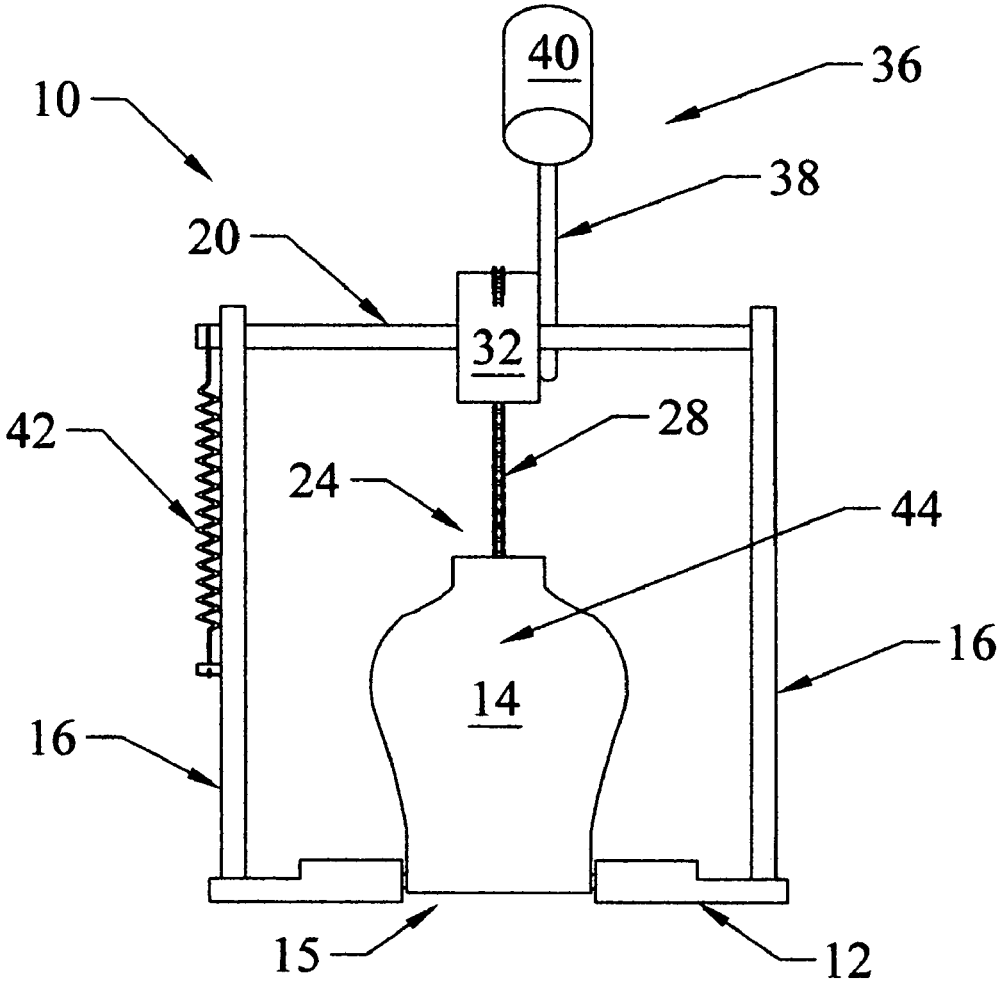
FIG. 2 is a rear elevation view of the pedal of FIG. 1
Figure 4:
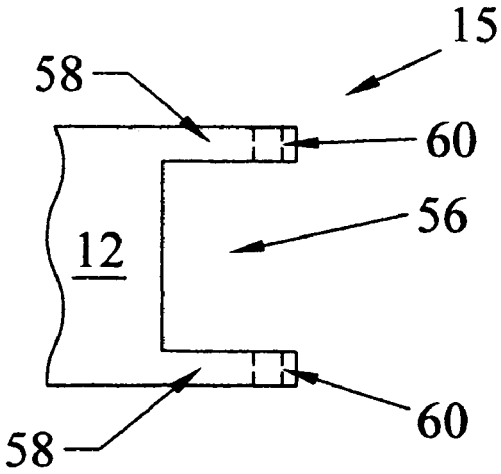
FIG. 4 is a top view of a preferred embodiment of the pivot region of the base plate.
Figure 3:
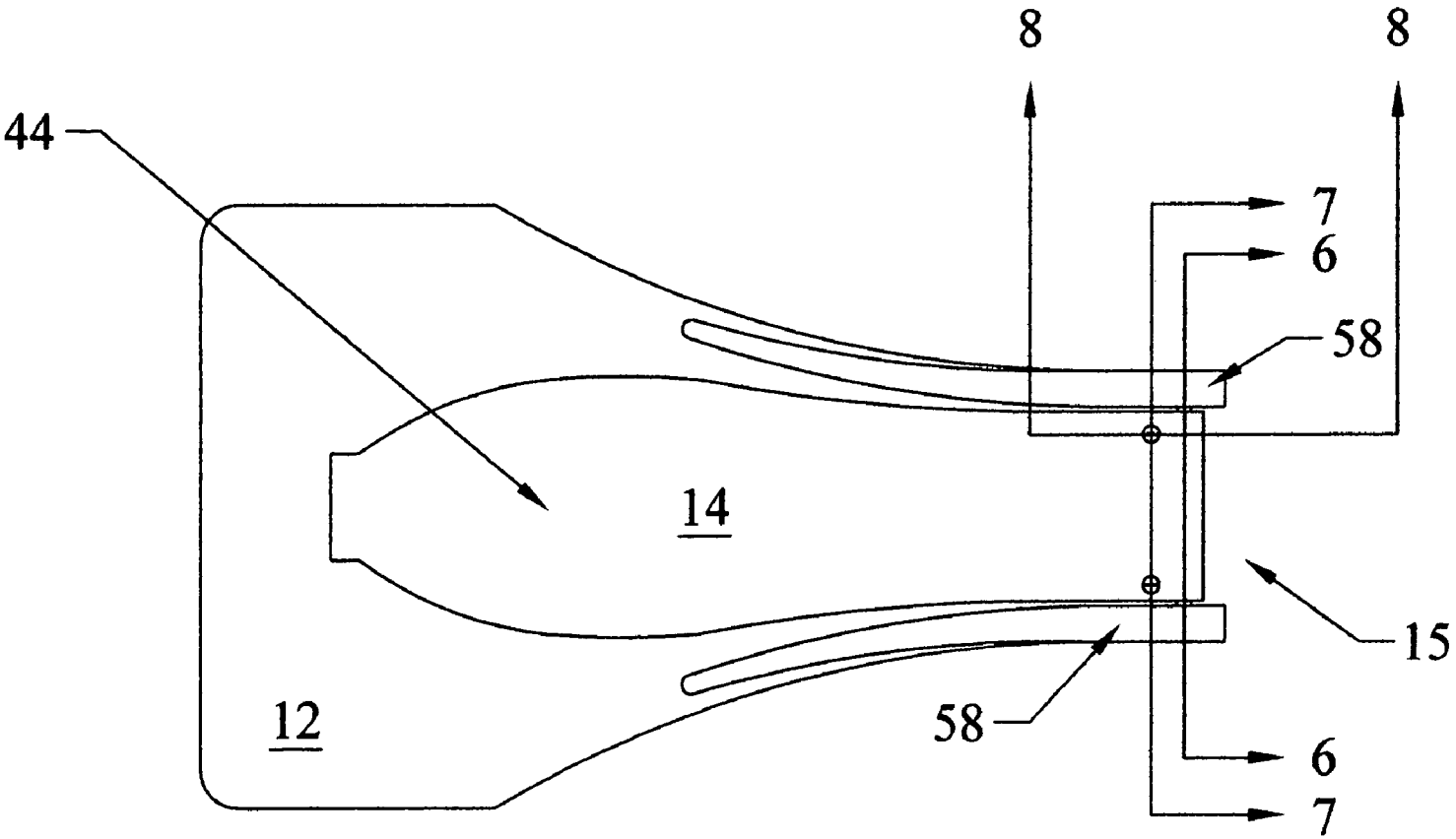
FIG. 3 is a top view of the base plate and pivotally mounted foot plate of FIGS. 1 and 2, those elements above the foot pedal having been removed for clarity.
Figure 6:
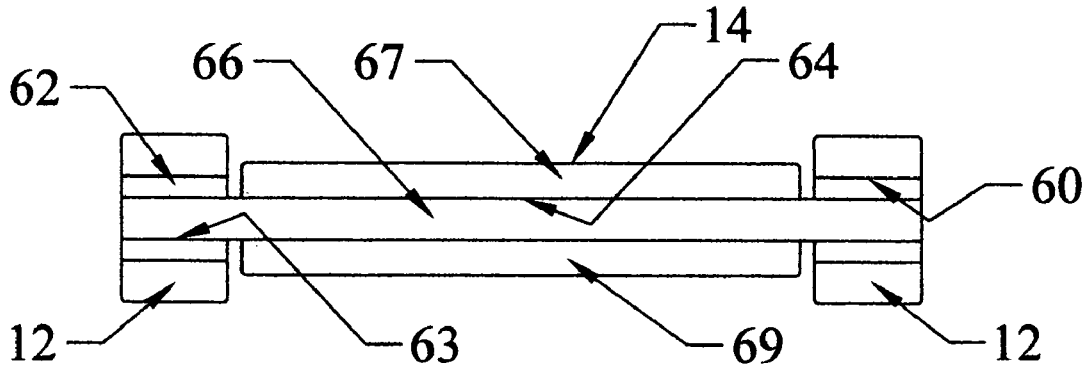
FIG. 6 is a cross-sectional view of the pivot mount of the foot plate from the base plate taken along line 6-6 of FIG. 3.
Figure 7:
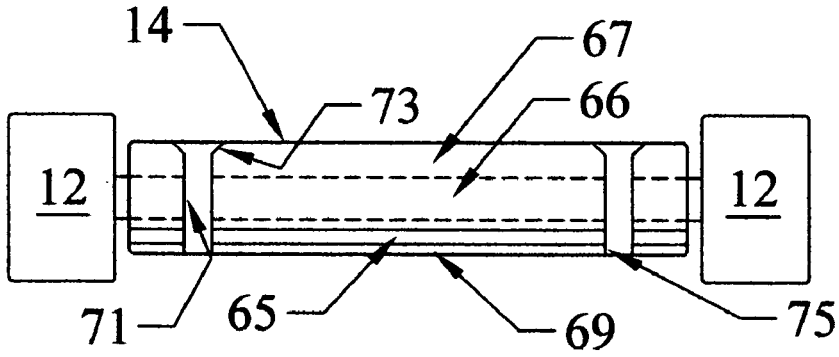
FIG. 7 is a cross-sectional view of the pivot mount of the foot plate from the base plate taken along line 7-7 of FIG. 3.

Illustrated in FIGS. 1-3 is a foot pedal 10 in accordance with the invention. This pedal illustrates only one embodiment of such a pedal 10. A base plate 12 is intended to rest on the playing surface 13 at a position appropriate for striking a drum or other percussion instrument (not shown). Herein, "front" will be described as the end of the pedal and its components intended to extend toward the drum, and "rear" the end of the pedal or its components toward the player. The playing surface 13 is generally external to the foot pedal 10, e.g., the ground or a stage floor; however, it is contemplated that the foot pedal 10 could carry its own playing surface 13, e.g., a broad thin plate attached below the base plate 14. From the rear of the base plate 12 is pivotally mounted, through a hinge or pivot mount 15, a foot plate 14. In FIG. 1, the foot plate 14 is shown at a first acute angle relative to the base plate 12, this being the rest position of the foot plate 14. Depression of the foot plate 14 by the toe of the user will pivot the foot plate to a second acute angle (not illustrated), this being the striking position of the foot plate.

Herein, the base plate 12, foot plate 14, and the flex point, hinge point, or pivot, will together be considered to be what is termed herein as a foot-actuated assembly. The foot-actuated assembly has means on the foot plate 14 for attachment to a drive means. The drive means herein is considered to be part of what is termed herein as the instrument-sounding assembly. The instrument-sounding assembly comprises the remaining parts of the foot pedal 10 beyond the foot-actuated assembly, including an instrument striker, a drive means operably linking the foot plate to the instrument striker, and biasing means to return the foot pedal to its rest position and the striker to its rest position remote from the instrument. The "foot-actuated assembly" is distinguished in the following description from the "instrument-sounding assembly" because the invention herein lies in the foot-actuated assembly, including the attachment means on the foot plate. The design of the foot-actuated assembly of the present invention enables the method of pedal playing in which the heel of the player is permitted to rest on the playing surface.

In many cases, the foot pedal 10 is to be manufactured and sold as a fully assembled item. However, a foot-actuated assembly in accordance with the present invention may be designed for retrofitting an existing pedal, i.e., exchanging the foot-actuated assembly of the present invention for the stock foot-actuated assembly, so as to allow the player's heel to rest on the playing surface 13 between pedal depressions. Herein, a "sweet spot" or "optimal location" is discussed for the tip of the player's foot to reach on the foot plate. As the "sweet spot" is defined by the balance of the pedal in its entirety, technically, the foot-actuated assembly by itself has no "sweet spot". However, foot-actuated assemblies in accordance with the present invention are designed and manufactured with either an entire pedal in mind or with retrofitting of a particular pre-existing pedal in mind. It is further to be appreciate that the exact "sweet spot" is adjustable through various pedal adjustments that each player may use to particularize the pedal for his or her use.

The illustrated embodiment has an instrument-sounding assembly that is typical of a drum pedal. Various drum pedals exist and can be envisioned in which the instrument-assembly deviates in one or more aspects from the illustrated drum pedal. Some of these possible deviations, although by no means all, will be noted hereinafter.

In the illustrated embodiment, extending upwards from near the front of the base plate 12 and flanking the foot plate 14 are a pair of towers or uprights 16; in FIG. 1 the second tower is behind the one tower that is illustrated. The towers 16 support a rotatable shaft or axel 20 extending between the towers. The shaft 20 is rotatable from a rest position to a striking position. It is to be noted that there are existing pedal designs (not shown) in which a robust, single tower is positioned along one side of the foot plate 14, this single tower supporting the rotatable shaft or axel, and the foot-actuated assembly of the present invention is applicable to any such variations of the instrument-sounding assembly.

From a front location indicated at 24 on the foot plate 14, is a drive means in the form of a chain or belt 28 that wraps partially around a wheel 32 axially mounted on the shaft 20. When the foot plate 14 is depressed to its striking position, the drive chain 28 rotates the shaft counterclockwise (relative to FIG. 1). Mounted from the rotatable shaft 20 is a beater or striker 36 comprising a shaft 38 and ball 40. Rotation of the rotatable shaft 20 swings the beater 36 in an arc from the rest position shown in FIG. 1 in solid to a striking position shown in outline. It is to be noted that other mechanical linkages between the front of the foot plate 14 and the shaft 20, as are known in the art, may similarly be used in the foot pedal 10 of the present invention.

Biasing means (or a biaser) 42 in the form of an expansion spring is mounted from the tower 16 illustrated in FIG. 1 to the end of the shaft 20. This spring 42 biases the shaft toward its rest position. Thus, after the beater ball has struck the instrument (in the striking position shown in broken line in FIG. 1) and foot pressure is removed from the foot plate 14, the spring biases the shaft clockwise (relative to FIG. 1) to its rest position, and thereby swings the beater 36 back to its rest position (shown in solid in FIG. 1). Clockwise rotation of the rotatable shaft 20, through the drive chain 28, also lifts the foot plate 14 to its rest position. While the biaser 42 in the illustrated embodiment is an expansion spring, other biasing means, such as compression springs, coil springs, combinations of springs, etc. could be incorporated in the instrument-sounding assembly of a foot pedal to return the beater 36 to its rest position and the foot plate 14 to its rest position.

Each pedal 10 is constructed such that there is a "sweet spot" 44 along the foot plate 14 where the tip of the player's foot should be located for optimal rebound and control of the pedal. The "sweet spot" 44 for each pedal 10 is determined by the entire mechanism of each pedal, including the levering action of the foot pedal 14 and the resistance to rotation by the weight of the beater 36 and the biasing force of the return spring 42. Typically the "sweet spot" is about three-fourths of the way up from the rear of the foot plate 14. The foot 43 shown in broken line in FIG. 1 is in a rest position with the toe located on the "sweet spot" 44. As can be seen in FIG. 1, with the tip of the foot on the "sweet spot" 44, the player's heel rests on the playing surface 13. In the "heel up" technique of playing, the player lifts his or her heel, depresses the foot plate at the "sweet spot" 44 with the tip of his or her foot, and then drops his or her heel to the playing surface 13, without risking the discomfort of contacting the edge of a heel plate. In a "heel down" technique, the player merely depresses the foot plate 14 with the tip of his or her foot, maintaining the heel on the ground and the toe at the "sweet spot" 44. It is found that with the rest position of the heel on the playing surface 13, there is less of a tendency for the tip of the player's foot to slip from the "sweet spot".

Illustrated in FIGS. 4-8 are views of a currently preferred embodiment of the pivot 15 of a foot plate 14 and base plate 12. The base plate 12 is fabricated with a U-shaped indentation 56 (FIG. 4) in its rear end, leaving a pair of lateral tabs 58. The rear portion of the foot plate 14 is proportioned to be received in the indentation 56 between the tabs 58 and is pivotally mounted between the tabs for reciprocation between its rest and striking positions.

Figure 5:
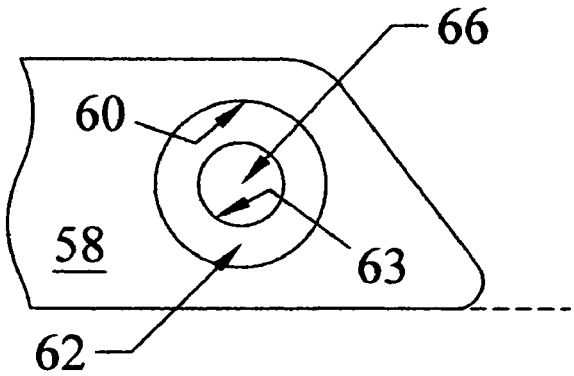
FIG. 5 is a side elevation view of the preferred embodiment of the pivot of the foot pedal in the region shown in FIG. 4.

As seen in greater detail in FIG. 5, through-bores 60 extend through the base plate tabs 58 transverse to the longitudinal (front to rear) axis of the base plate 12. A bushing 62 is inserted into each through-bore 60, each bushing having an axial through-hole 63 in which ends of a cylindrical rod or axel 66 are mounted for rotation.

Figure 8:
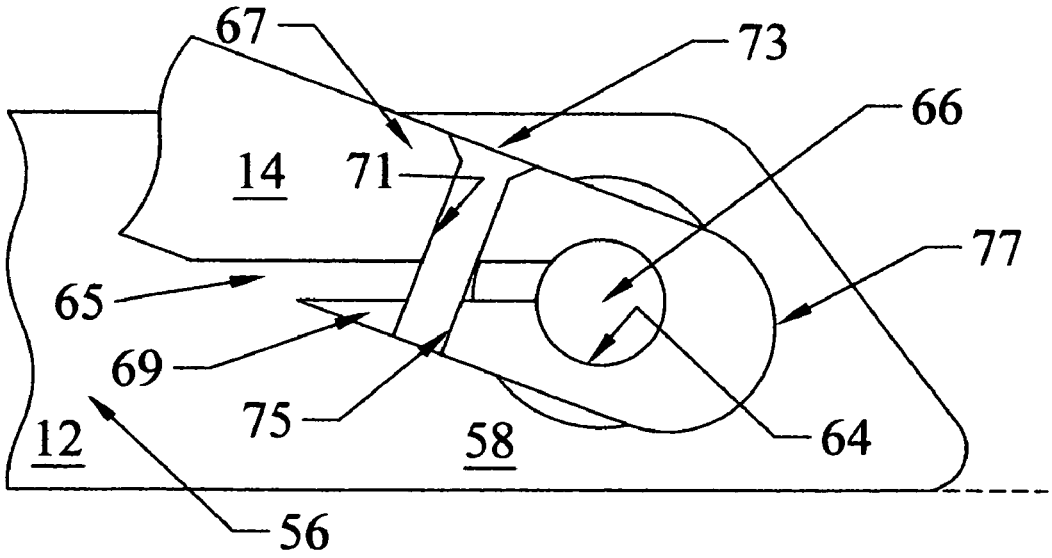
FIG. 8 is a cross-sectional view of the pivot mount of the foot plate from the base plate along line 8-8 of FIG. 3.

The rear of the foot plate 14, that is proportioned to be received in the U-shaped indentation 56, has a transverse through-bore 64 to align with through-holes 63 of the bushings 62 and receive the central portion of the axel 66. A split 65, as best seen in FIG. 8, is formed extending diagonally rearward from the bottom of the foot plate 14 extending inward to the through-bore 64, creating an upper portion 67 and lower portion 69 of a clamping region. A pair of vertical bores 71 are formed through the upper and lower portions 67, 69 of the clamping region of the foot plate 14, extending through the split 65; the portion 75 of each of the bores in the lower portion 69 of the clamping region are threaded. Each of a pair of screws 73 extends from the top face of the foot plate through the upper portion of the clamping region and each is tightened into the threaded lower portions 75 of the corresponding bore to firmly clamp the axel 66 within the through-bore 64. Clamping of the foot-plate 14 to the axel 66 in this manner rigidly attaches the foot plate to the axel along the entire length of the through-bore 64, distributing stress along the entire corresponding length of the axel.

For maintenance-free precision movement of the foot plate 14 relative to the base plate 12, and to eliminate extraneous noise, the preferred bushings 62 are low-friction polytetrafluoroethylene (PTFE)—lined steel bushings, sold as "DU Self-Lubricating Bearings" by Garlock Bearing, LLC.

In this embodiment, the rear of the foot plate 14 is on the playing surface 13. With the foot plate 12 of an appropriate length and the pedal manufactured so that the "sweet spot" is upward along the pedal less than the length of the player's foot, the player's heel rests comfortably on the playing surface in the rest position of the "heel-up" technique and while playing using the "heel-down" technique.

Of course there is variance in the size of player's feet, but the pedal of the present invention may be manufactured in several sizes to meet the needs of the particular player. Typically, the foot plate 14 of the present invention is between about 22 and about 32 cm. from its rear end to its connection to the drive belt. The "sweet spot" is typically between about 15 and about 20 cm. up from the rear end of the foot plate, resulting in the heel of the player extending about 4 to about 6 cm. behind the rear of the foot plate with the tip of the players foot extending to the "sweet spot". As seen in FIG. 8, the rear end of the foot plate 14 has a curved edge 77 so as to eliminate sharp edges that might wear on the player's foot during extended playing.

In the pedal of FIG. 1, there is no heel piece behind the foot pedal. To ease transition of the foot from the pedal 10 to the playing surface 13, the pivotal axis, i.e., the axis of the foot-actuated assembly axel 66, is low to the ground, preferably not greater than 8 mm. above the playing surface, typically 5 mm.

Figure 9:
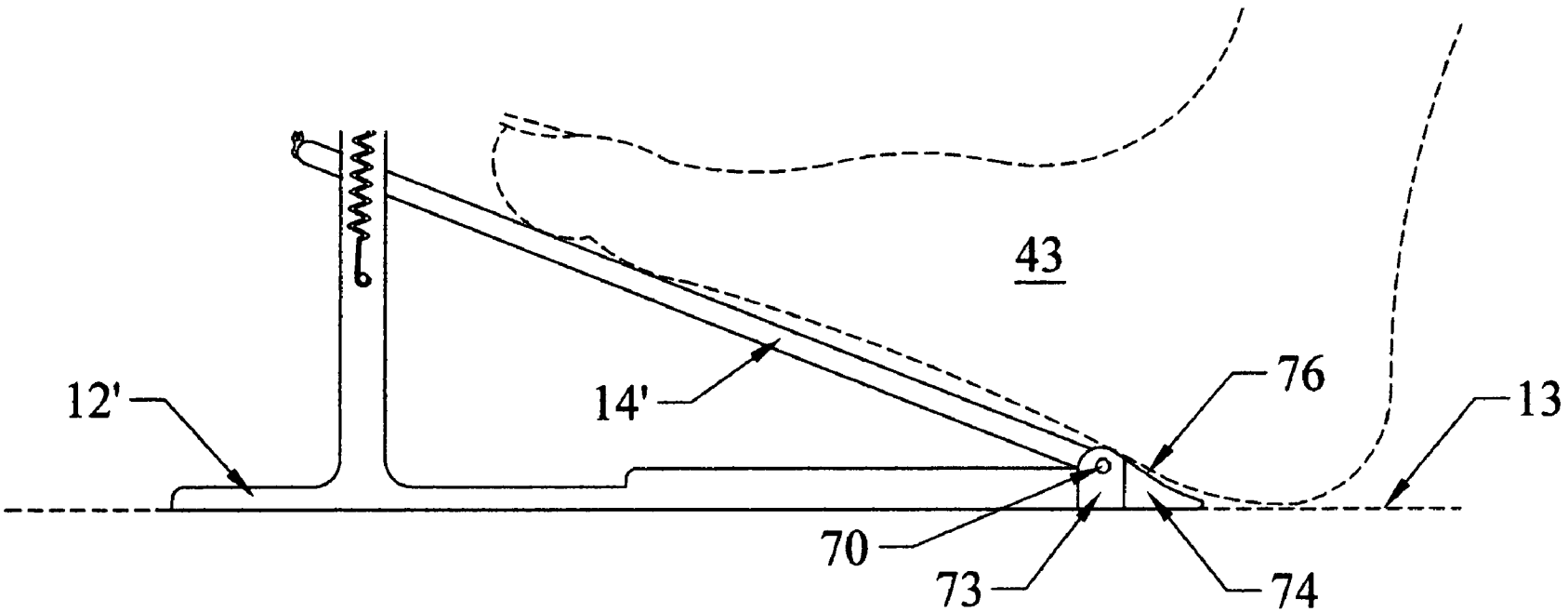
FIG. 9 is a side elevation view of an alternative embodiment of the foot plate and base plate of the present invention in which a short heel guide extends rearward of the foot plate.

Illustrated in FIG. 9 is an alternative embodiment of a base plate 12' and foot plate 14' assembly. In this case, the rear end of the foot plate 14' rests on the base plate 12' towards its rear end, and a pair of tabs 73 extends upward from the base plate to support the pivotal axel. Because in this pedal, the pivotal axis is somewhat more elevated above the playing surface 13, e.g., typically 10-12 mm., a short, e.g. 1-2 cm. long, heel guide 74 is provided rearward of the foot plate 14'. The upper surface 76 of the heel guide 74 is inclined downward toward the playing surface 13, providing the player's heel a transition from the foot plate 14' to the playing surface. The heel guide 74 is distinguishable from heel plates of many currently used pedals in that the guide 74 is too short for the heel to rest thereon; instead, the heel extends to and rests on the playing surface 13. In FIG. 9, the heel guide is illustrated as a piece attached behind the base plate. Alternatively, the base plate could extend rearward beyond the foot plate with the heel guide mounted on the base plate and behind the foot plate. Or the heel guide could be integrally formed as part of the base plate. In all cases, the heel guide would guide the player's foot from the foot plate to the playing surface.

In the FIG. 1 and FIG. 9 embodiments, the foot plate swings relative to the base plate by means of a pivot or hinge mechanism. There are mechanical alternatives to such a pivot that are considered within the scope of the present invention. For example, a resilient flexible member might connect the foot plate to the base plate, allowing the foot plate to swing between its rest position and depressed position.

Figure 10:
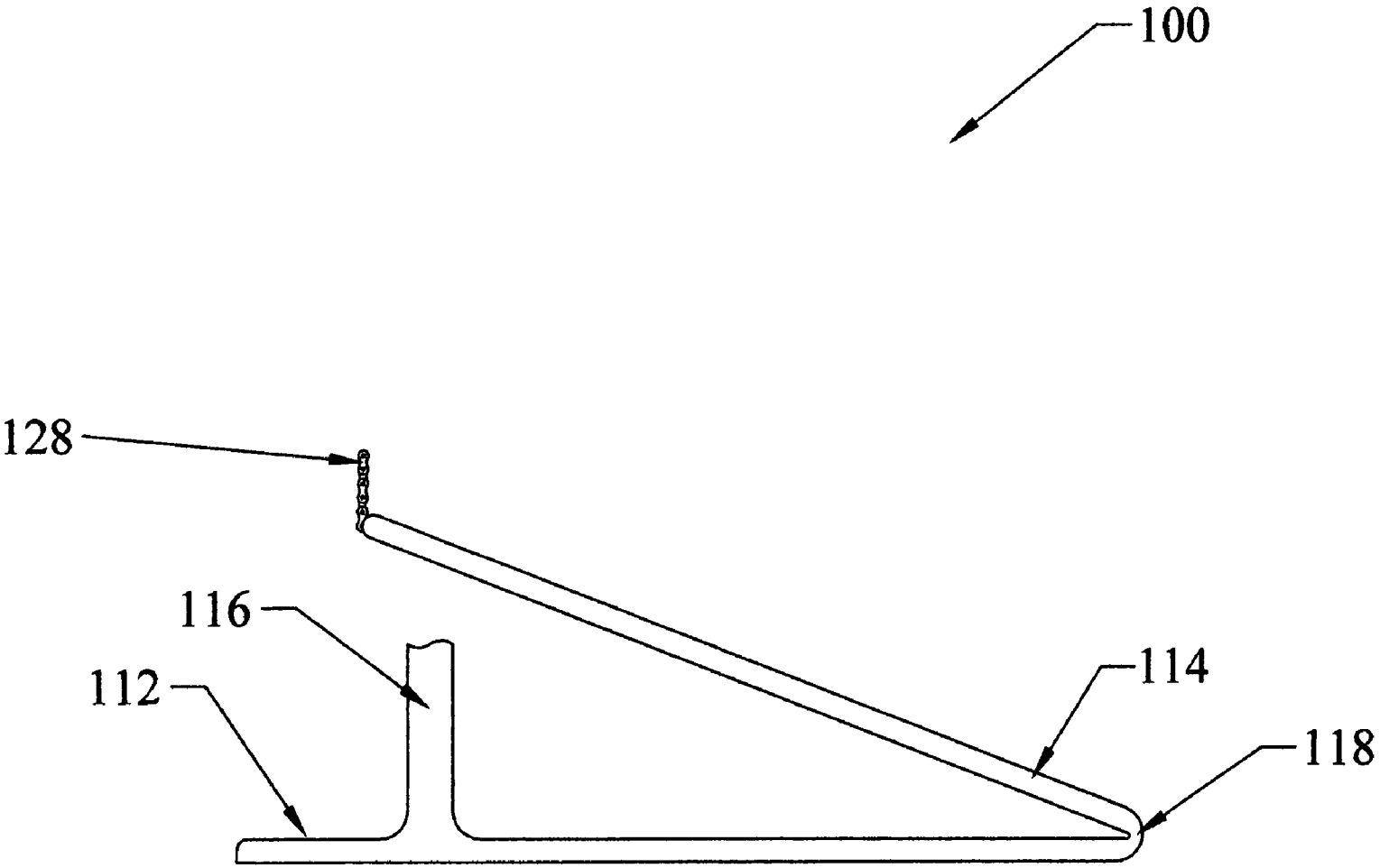
FIG. 10 is a side elevation view of a unitary foot-actuated assembly in accordance with the present invention.

In this regard, illustrated in FIG. 10 is a unitary structure 100 comprising a foot plate section 114, a base plate section 112, and a hinge section 118 that is reduced in thickness relative to the thickness of the foot plate and base plate sections, giving the hinge section flexibility to define a pivot point, whereby the foot plate section swings relative to the base plate section between its rest position and its depressed position. A drive chain or belt 128 is connected at a front location of the foot plate section 114, and a tower 116 for supporting a beater shaft rises from the base plate section 112. The unitary structure 100 could be formed of a metal, such as spring steel, or a suitably durable and resiliently deformable polymeric material.

What is claimed is:

1. A foot-actuated assembly for inclusion in a foot pedal that comprises said foot-actuated assembly and an instrument-sounding assembly, which foot pedal operates to sound a musical instrument, said foot-actuated assembly comprising:

(a) a base plate having a front end and a rear end, said base plate being adapted to lie on a flat playing surface, (b) a foot plate having a front location and a rear location, said front location having means for connection to said instrument-sounding assembly, said rear location of said foot plate being hinged adjacent to said rear end of said base plate to define a pivotal axis such that said foot plate can swing, when depressed by pressure from the foot of a player, from a rest position at a first acute angle to said base plate to a striking position at a lesser second acute angle to said base plate, wherein said foot plate is constructed with an optimal spot for placement of the tip of a player's foot, and wherein said foot plate is configured such that when the foot of a player is flat against said foot plate in said rest position with the tip of the player's foot in said optimal spot, the heel of the player's foot rests on the playing surface, such as a floor, stage or ground, on which said assembly is placed for playing.

2. The foot-actuated assembly of claim 1 wherein said pivotal axis is substantially at the rear end of said base plate.

3. The foot-actuated assembly of claim 2 wherein no heel piece is provided behind said foot plate.

4. The foot actuated assembly of claim 3 wherein said pivotal axis is about 8 mm. or less above the playing surface when said base plate lies on said playing surface.

5. The foot-actuated assembly of claim 1 wherein a heel guide is located rearward of said foot plate to guide the heel of a player to the playing surface.

6. The foot-actuated assembly of claim 5 wherein said heel guide has an upper surface inclined from behind said foot plate downward toward the playing surface.

7. The foot-actuated assembly of claim 5 wherein said heel guide extends between about 1 and about 2 centimeters rearward of said foot plate.

8. The foot-actuated assembly of claim 5 wherein said pivotal axis is about 12 mm. or less above the playing surface when said base plate lies on the playing surface.

9. A foot pedal comprising the foot-actuated assembly in accordance with claim 1 in combination with an instrument-sounding assembly.

10. The foot pedal according to claim 9 wherein said instrument-sounding assembly comprises an instrument striker, drive means operably linking said connection means of said foot plate with said instrument striker such that foot pressure on said foot plate to depress said foot plate moves said instrument striker from a position remote from an instrument into instrument-sounding contact with the instrument, and biasing means for returning said foot plate to said rest position and said instrument striker to said remote position when foot pressure is removed from said foot plate.

11. The foot-actuated assembly of claim 1 wherein said foot-actuated assembly is capable of being operably connected to a pre-existing instrument-sounding assembly to permit retrofitting of an existing foot pedal.

12. A method of playing a musical instrument comprising providing a foot pedal for playing the musical instrument, the pedal comprising a foot-actuated assembly and an instrument-sounding assembly, said foot-actuated assembly comprising (a) a base plate having a front end and a rear end, said base plate being adapted to lie on a flat playing surface, (b) a foot plate having a front location and a rear location, said front location having means for connection to said instrument-sounding assembly, said rear location of said foot plate being hinged adjacent to said rear end of said base plate to define a pivotal axis such that said foot plate can swing, when depressed by pressure from the foot of a player, from a rest position at a first acute angle to said base plate to a striking position at a lesser second acute angle to said base plate, wherein said foot plate is constructed with an optimal spot for placement of the tip of a player's foot, and wherein said foot plate is configured such that when the foot of a player is flat against said foot plate in said rest position with the tip of the player's foot in said optimal spot, the heel of the player's foot rests on the playing surface such as a floor, stage or ground, on which said assembly is placed for playing, and, playing the percussion instrument by operating the pedal with the tip of the player's foot on said optimal location of said foot plate and the player's heel resting or positioned to rest on the playing surface.

* * * * *